US005413429A

United States Patent [19]

Shiau

[11] Patent Number: 5,413,429

[45] Date of Patent: May 9, 1995

[54] WRITING INSTRUMENT WITH LIGHT ASSEMBLY

[76] Inventor: Shoei-Shuh Shiau, No.18, Alley 33, Lane 730, Chien-Hsing Rd., Taichung City, Taiwan, Prov. of China

[21] Appl. No.: 246,344

[22] Filed: May 18, 1994

[51] Int. Cl.[6] ..... B43K 29/10

[52] U.S. Cl. ..... 401/195; 362/118

[58] Field of Search ..... 401/195; 362/118

[56] References Cited

U.S. PATENT DOCUMENTS 3,045,111 7/1962 Hoenig ..... 240/6.46
5,275,497 1/1994 Shiau ..... 401/195

FOREIGN PATENT DOCUMENTS 584738 10/1959 Canada ..... 362/118
1018751 10/1957 Germany ..... 362/118
1252096 10/1967 Germany ..... 401/195

*Primary Examiner*—Steven A. Bratlie

*Attorney, Agent, or Firm*—Baker & Botts

[57] ABSTRACT

A writing instrument with a light assembly includes an elongated insulating switch bar, an insulating sleeve member, a pair of conductive tongues and a metallic clip assembly. The switch bar has two split members which extend radially and downwardly to define a receiving slot therebetween. The insulating sleeve member is sleeved around the split members and has two radial holding ribs which extend into the engaging slot of the switch bar and which is provided with a respective elongated engaging groove. Each of the conductive tongues has a section press-fitted into the engaging groove of the respective holding rib of the sleeve member to mount the former on the latter. The conductive tongues have two curved portions that cooperate to form a clamping ring between the split members. A conductive locking bolt extends axially into the receiving slot and engages the clamping ring and is fastened simultaneously to the switch bar to retain the sleeve member on the switch bar.

4 Claims, 6 Drawing Sheets

WRITING INSTRUMENT WITH LIGHT ASSEMBLY

BACKGROUND OF THE INVENTION

1. Field of the Invention

This invention relates to a writing instrument, more particularly to a writing instrument which has a light assembly.

2. Description of the Related Art

Writing under the presence of insufficient light is harmful to the eyes. Even in the presence of an external light source, a dim area is still provided around the writing tip of a conventional writing instrument due to the shadow of the hand which holds the writing instrument.

According to the U.S. Pat. No. 5,275,497, there is disclosed a writing instrument with a light assembly which is operable to provide additional light when writing. The writing instrument includes a conductive barrel, a nib assembly, a thrusting assembly and a lamp assembly. The conductive barrel has an open top end and an open bottom end. The nib assembly includes a hollow nib casing which is transparent and which has an open top end connected to the open bottom end of the barrel and a tapered open bottom end. An ink tube has an upper end and a lower writing tip and is disposed inside the nib casing. A coil spring is sleeved on the ink tube to bias the ink tube inwardly of the barrel. The ink tube is movable between a first position, wherein the writing tip is disposed in the nib casing and a second position, wherein the writing tip extends out of the nib casing through the open bottom end of the latter. The thrusting assembly includes a hollow insulating cap member which has an open bottom end connected to the open top end of the barrel and an open top end. A push-button is provided on the open top end of the cap member and is operable to move the ink tube between the first and second positions. A conductive clip assembly is clamped between the cap member and the open top end of the barrel. A transparent push-member is disposed slidably inside the conductive barrel adjacent to the nib casing and has a lower end which abuts against the upper end of the ink tube. The lamp assembly includes an insulating lamp holder which is disposed slidably inside the barrel above the push-member and which has a lower end abutting against the push-member. The lamp holder retains a lamp therein. The lamp has a first electrode in electrical contact with the barrel and a second electrode. An insulating battery seat is disposed slidably inside the barrel above the lamp holder and has a lower end abutting against the lamp holder. The battery seat receives a battery therein. The battery has a first terminal connected electrically to the second electrode of the lamp and a second terminal. The battery seat further has a first conductive spring connected to the second terminal of the battery so as to bias the battery toward the lamp holder. The thrusting assembly further includes an insulating switch bar which has an upper end extending into the cap member and which is in contact with the lower end of the push-button. The insulating switch bar has a lower end extending into the barrel and is in contact with the battery seat. A conductive member is positioned adjacent to the upper end of the insulating switch bar. A second conductive spring is provided in the insulating switch bar and biases the conductive member to contact the first conductive spring so as to connect electrically the conductive member and the second terminal of the battery. The insulating switch bar is movable between a switch-off condition, wherein the ink tube is in the first position and the conductive member is spaced from the clip member to turn off the lamp, and a switch-on condition, wherein the ink tube is in the second position and the conductive member is in contact with the clip member to turn on the lamp.

In the above-mentioned writing instrument, the lower end portion of the insulating switch bar has an axial blind bore to receive a spring member therein and a pair of split members extending axially and downwardly from the lower end portion to define a receiving slot which is communicated with the axial blind bore. The conductive clip assembly includes a ring member which has a pair of inwardly and radially protrusions. The conductive member employed in the disclosed writing instrument is cylinder-shaped with small diameter and has two opposed radial extensions which project outwardly from a position adjacent to its lower end. When the conductive member is received in the insulating switch bar, an upper portion of the conductive member extends into the axial blind bore of the insulating switch bar while the radial extensions of the conductive member project outwardly from the insulating switch bar via the receiving slot of the same. During the operation of the push-button to move the ink tube into a writing or non-writing position, the conductive member correspondingly moves together downwardly or upwardly with the push-button. The second conductive spring is disposed slidably in the receiving slot of the insulating switch bar without any retaining means. Therefore, the vertically extending position of the second conductive spring is not stable and fails to bias and retain the radial extensions of the conductive member in a horizontally position. This results in misalignment and poor contact of the radial extensions of the conductive member relative to the inwardly and radially protrusions of the clip assembly, thereby resulting in poor electrical contact of the lamp assembly.

SUMMARY OF THE INVENTION

The main objective of the present invention is to provide a writing instrument with a light assembly which has a better electrical contact structure when compared to the above-mentioned writing instrument.

In the present invention, the cylinder-shaped conductive member employed in the prior writing instrument is to be substituted by an insulating sleeve member and a pair of conductive tongues mounted to the insulating sleeve member. The components employed in an embodiment of a writing instrument according the present invention are generally the same as that disclosed in the prior art, except for the thrusting assembly. The thrusting assembly of the writing instrument accordingly includes a cap member, a push-button, an insulating switch bar, an insulating sleeve member, a pair of conductive tongues, a conductive locking bolt, means for rotating the insulating switch bar relative to the push-button, and a clip assembly. The cap member is mounted to an upper open end of a conductive barrel which has a movable lighting assembly therein. The light assembly has a first terminal in electrical communication with the conductive barrel and a second terminal. The push-button is disposed on an upper open end of the cap member. The insulating switch bar has an upper portion that extends into the cap member and contacts slidingly a lower end of the push-button. The insulating switch bar has a lower portion with an axial blind bore and from which two split members extend axially and downwardly to define a receiving slot between the split members. The insulating sleeve member is sleeved around the split members of the insulating switch bar and has an external surface covered by the conductive tongues at two opposed portions when the conductive tongues are mounted to the insulating sleeve member. The conductive tongues have a pair of curved portions that extend into the split members and that cooperatively form a clamping ring therebetween. The conductive locking bolt is inserted axially between the split members and which engages the clamping ring in order to retain the insulating sleeve member on the insulating switch bar. When the thrusting assembly is assembled to the conductive barrel, a lowermost end of the conductive locking bolt extends into the conductive barrel so as to be in electrical communication with the second terminal of the light assembly.

In order to enhance the stability of the insulating sleeve member on the insulating switch bar, an insulated retaining ring member is sleeved around the insulating switch bar below the insulating sleeve member and is connected to the open bottom end of the conductive barrel. Thus, the insulating sleeve member is retained stationarily on the insulating switch bar and the latter is prevented from disengaging the cap member. The insulating sleeve member is further provided with a pair of opposed holding ribs which extend inwardly and radially therefrom. The holding ribs respectively have an elongated groove that receives a section of each of the conductive tongues adjacent to the curved portions such that the curved portions cooperatively form the clamping ring. The clamping ring is thus retained stably between the split members. The clip assembly includes a ring member sleeved around the insulating switch bar and disposed between the push-button and the insulating sleeve member, a pair of opposed rib members which extend axially and downwardly and which contact the external surface of the insulating sleeve member, and a clip member disposed exteriorly of the conductive barrel and in electrical communication with the same.

When the push-button is operated in order to move an ink tube of the writing instrument between writing and non-writing positions, the insulating switch bar rotates relative to the push-button and correspondingly rotates the insulating sleeve member together with the same. Since the insulating sleeve member is retained stationarily on the insulating switch bar, the conductive tongues of the insulating sleeve member engages the rib members of the clip assembly when the insulating switch bar is rotated a certain angular distance with respect to the push-button, thereby providing sufficient lighting and disposing the ink tube at the writing position with the light assembly at a switch-on condition.

The position of the pair of conductive tongues mounted on the insulating sleeve member is not altered regardless of the length of the period of use. Thus, the writing instrument installed with the light assembly which includes the insulating sleeve member with modified conductive tongues possesses finer electrical contact qualities when compared with the prior art.

BRIEF DESCRIPTION OF THE DRAWINGS

Other features and advantages of the present invention will become more apparent in the following detailed descriptions of the preferred embodiment with reference to the accompanying drawings, in which.

DETAILED DESCRIPTION OF THE PREFERRED EMBODIMENT

Figure 1:
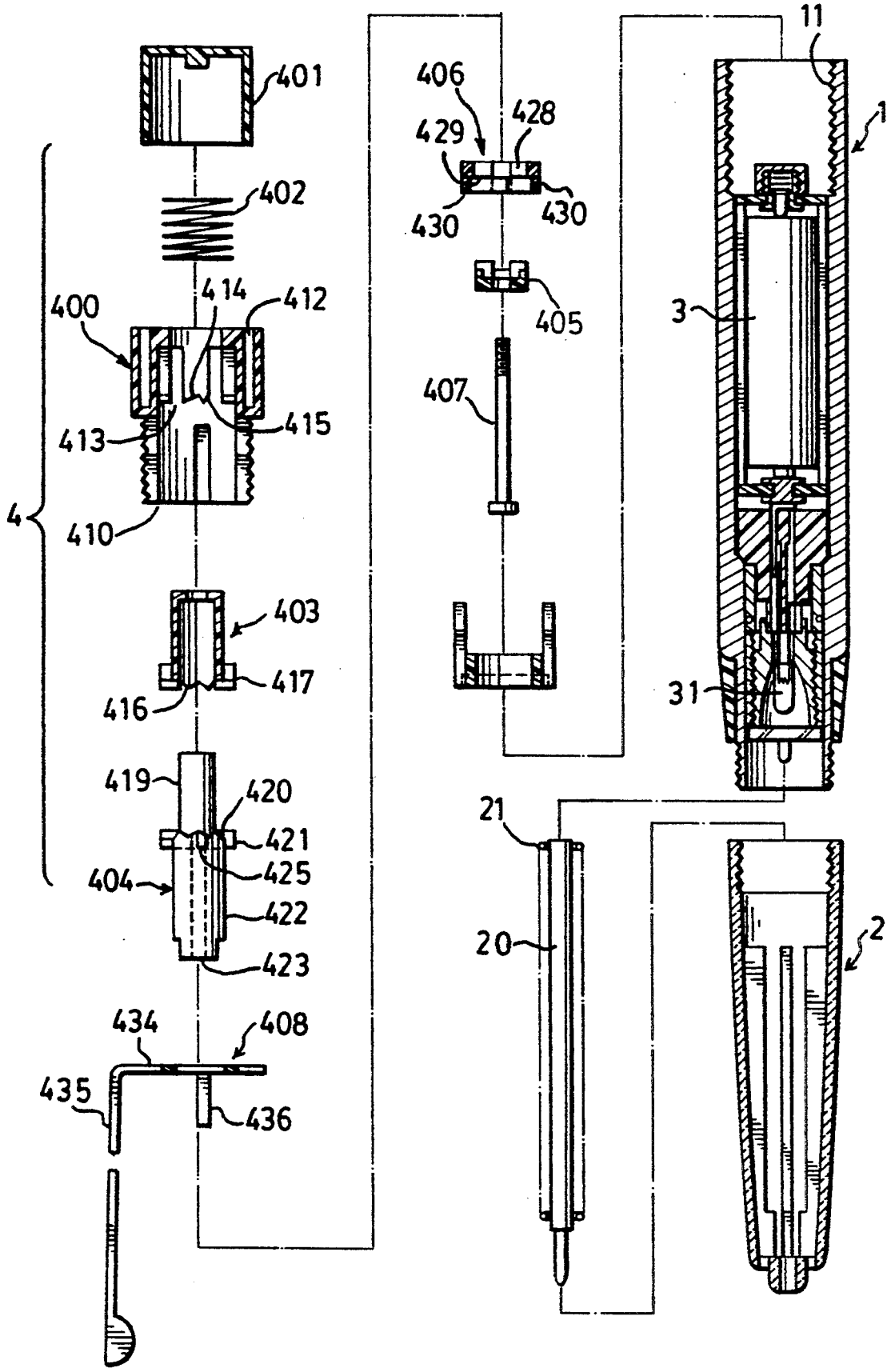
FIG. 1 shows an exploded view of a writing instrument with light assembly according to the present invention.

Referring to FIG. 1, a writing instrument with light assembly of the present invention is shown to comprise a conductive barrel 1, a nib assembly 2, a lamp assembly 3 and a thrusting assembly 4.

Figure 2:
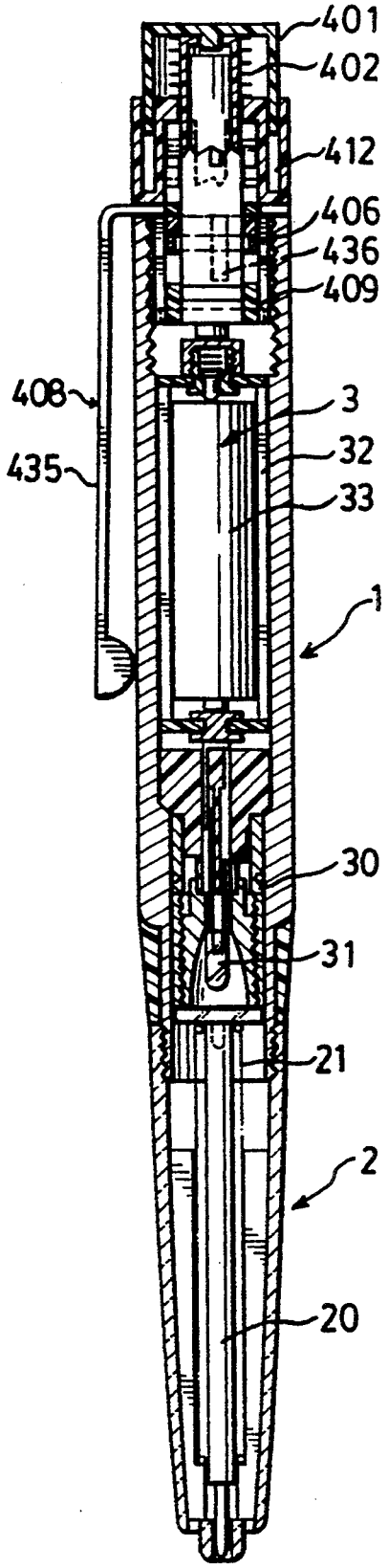
FIG. 2 shows an assembled cross sectional view of the writing instrument with a light assembly of the present invention.

The conductive barrel 1, the nib casing 2 and the lamp assembly 3 are generally similar to those of the writing instrument disclosed in U.S. Pat. No. 5,275,497. As best illustrated in FIG. 2, the lamp assembly 3 is disposed slidably in the conductive barrel 1 and includes a lamp holder 30 with a lamp 31, and a battery seat 32 with a battery 33. The lamp 31 has a first electrode connected to a first terminal of the battery 33 and a second electrode in electrical communication with the conductive barrel 1. The nib assembly 2 includes a transparent nib casing which has an open top end connected to a lower end of the conductive barrel 1, an open bottom end and an ink tube 20 attached with a coil spring 21 provided therearound. The ink tube 20 is disposed within the nib casing. The coil spring 21 has a first end that bears against the nib casing and a second end that pushes an upper end of the ink tube 20 inwardly of the conductive barrel 1 so as to abut the lowermost end of the lamp assembly 3.

According to the present invention, the structure of a thrusting assembly 4 which is mounted at a top open end of the conductive barrel 1 in order to move the ink tube 20 is modified in order to overcome the above-mentioned drawbacks that are associated with the prior art. The thrusting assembly accordingly includes a cap member 400, a push-button 403, an insulating switch bar 404, an insulating plug 405, an insulating sleeve member 406, a conductive locking bolt 407, means for rotating the insulating switch bar 404 relative to the push-button 403, and a metallic clip assembly 408.

Figure 3:
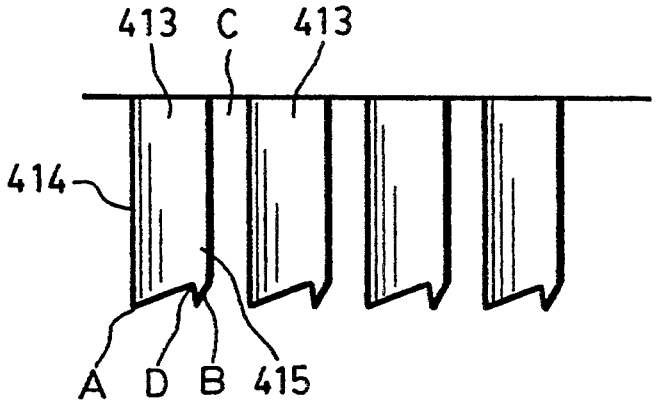
FIG. 3 illustrates a schematic view in which the inner surface of the tubular wall of a cap member of the writing instrument according to the present invention is translated into a plane.
Figure 4:
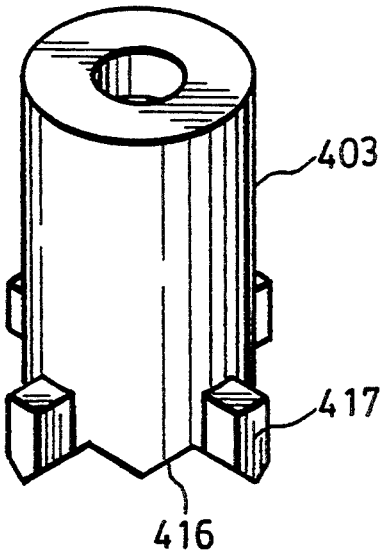
FIG. 4 shows a perspective view of a push-button employed in the writing instrument of the present invention.

The cap member 400 is connected threadedly to the open top end of the conductive barrel 1. Referring to FIG. 3, the tubular wall body of the cap member 400 is translated into a plane to show its inner wall surface. The rotating means employed in this embodiment is constituted by four angularly spaced and axially extending engaging ribs 413, four angularly spaced and axially extending projections 417 formed on an external surface of the push-button 413 (see FIG. 4) and four angularly spaced and axially extending protrusions 421 around the insulating switch bar 404 adjacent to a lower end portion of the latter. Each adjacent pair of the engaging ribs 413 cooperatively define a gap (C) therebetween. Each of the engaging ribs 413 has two parallel sides 414, 415 with two distal ends (A, B) and two inclined abutting faces that cooperatively define an engaging notch (D) between the distal ends (A, B). The cap member 400 has an annular receiving slot 412 formed at an upper end portion to receive resiliently a decorative push-button 401 therein. The push-button 403 is tubular-shaped with a closed upper end and an open bottom end which is formed with a circle of teeth 416 adjacent to the projections 417 of the same.

The insulating switch bar 404 is substantially cylinder-shaped and has a circle of upwardly oriented mating teeth 425 formed around a lower end portion adjacent to the protrusions 421 of the same. The lower end portion of the insulating switch bar 404 has an axial threaded blind bore 423 and a pair of split members 422 which extend axially and downwardly therefrom and which cooperatively define a receiving slot between the split members 422. The receiving slot is communicated with the axial blind bore 423 of the insulating switch bar 404.

Figure 5A:
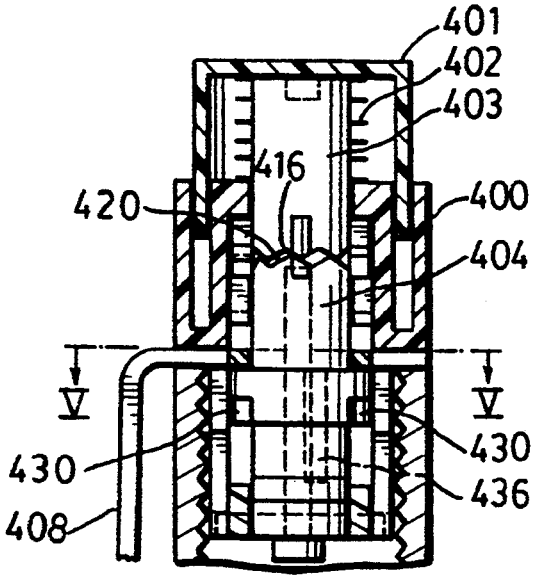
FIG. 5 (A) shows a cross sectional view of an upper portion of the writing instrument of the present invention, illustrating a non-writing position.
FIG. 5(B) shows a cross section view of the upper portion of the writing instrument of the present invention taken along the line V—V in FIG. 5(A)
Figure 5B:
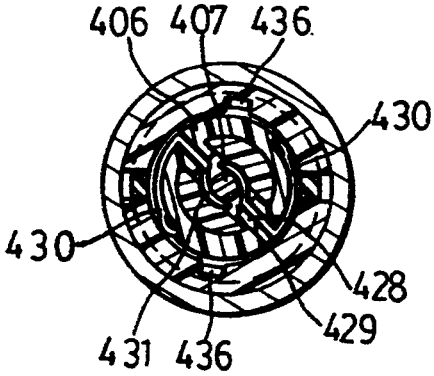

Referring to FIGS. 1, 5(A) and 5(B), the insulating sleeve member 406 is sleeved around the split members 422 of the insulating switch bar 404 and has a pair of holding ribs 428 which extend radially and inwardly therefrom. Each of the holding ribs 428 has an elongated groove 429 in which a section of each of the conductive tongues 430 is press-fitted such that the conductive tongues 430 cover an external surface of the insulating sleeve member 406 at two opposed portions. The conductive tongues 430 have two curved portions 431 which cooperate to form a clamping ring between the split members 422. The insulating plug 405 is attached to a lowermost end of the split members 422. The conductive locking bolt 407 is inserted axially into the receiving slot 423 of the split members 422 and is connected threadedly in the axial blind bore 425 of the insulating switch bar 404 such that the locking bolt 407 engages the clamping ring. The sleeve member 406 is thus retained on the split members 422 of the insulating switch bar 404. Note that the projections 417 of the push-button 403 and the protrusions 421 of the insulating switch bar 404 are constructed with inclined abutting faces, the purpose of which will be explained in the following paragraphs.

The metallic clip assembly 408 includes a ring member 434 sleeved around the split members 422 of the insulating switch bar 404 so as to be disposed between the push-button 403 and the insulating sleeve member 406, a pair of opposed rib members 436 which extend axially and downwardly from the ring member 434 ,and which contact the external surface of the sleeve member 406 and a clip member 435.

Referring once more to FIG. 2, the push-button 403 is inserted into the cap member 400 via the bottom open end 410 of the latter such that the closed upper end of the push-button 403 protrudes out of the cap member 400. Under such a condition, the projections 417 of the push-button 403 are disposed in the gaps (C) of the engaging rib 413 of the cap member 400. The upper end portion 419 of the insulating switch bar 404 is inserted into the cap member 400 in order to mesh the circle of mating teeth 420 of the switch bar 404 with the circle of teeth 416 in the push-button 403. The lower end portion of the switch bar 404 extends into the conductive barrel 1 and is in electrical communication with a second terminal of the battery 33 in the light assembly 3. The clip member 435 is exposed exteriorly of the conductive barrel 1 and is in electrical contact with the latter. An insulated retaining ring member 409 can be sleeved around the split members 422 below the insulating sleeve member 406 and is connected to the bottom end of the cap member 400 for preventing the insulating sleeve member 406 from disengaging the insulating switch bar 404. Thus, the sleeve member 406 is retained on the switch bar 404 in a stable manner.

Figure 6A:
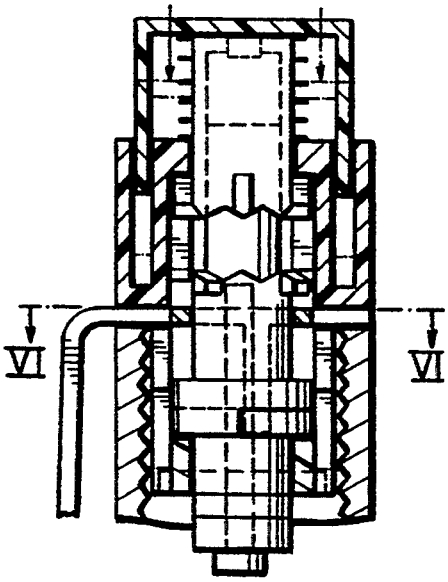
FIG. 6 (A) shows a cross sectional view of the upper portion of the writing instrument of the present invention, illustrating a writing position with the lamp assembly at a switch-off condition.
FIG. 6B) shows a cross sectional view of the upper portion of the writing instrument of the present invention taken along the line VI—VI in FIG. 6(A)
Figure 6B:
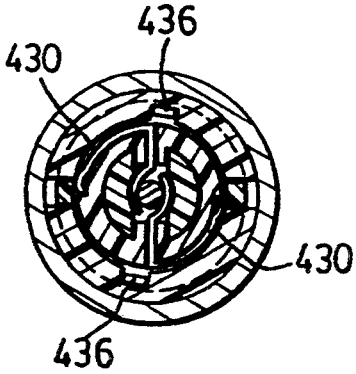
Figure 7A:
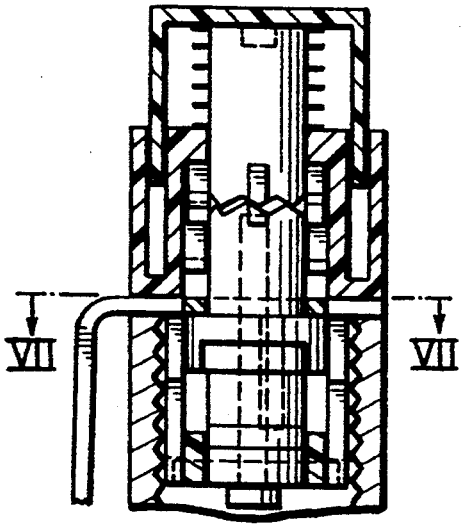
FIG. 7(A) shows a cross sectional view of the upper portion of the writing instrument of the present invention, illustrating a non-writing position.
Figure 8A:
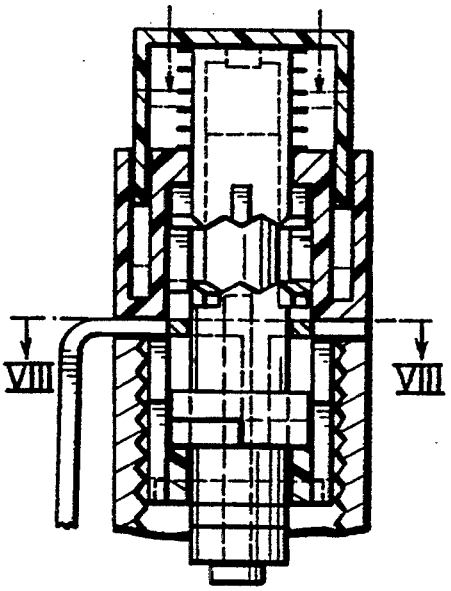
FIG. 8(A) shows a cross sectional view of the upper portion of the writing instrument of the present invention, illustrating a writing position with the light assembly at a switch-on condition.
Figure 7B:
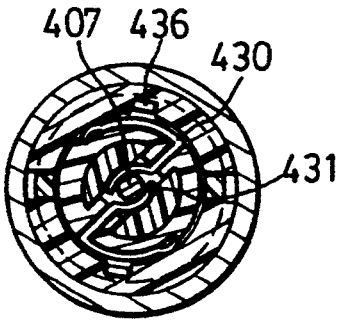
FIG. 7(B) shows a cross sectional view of the upper portion of the writing instrument of the present invention taken along the line VII—VII in FIG. 7(A)
Figure 8B:
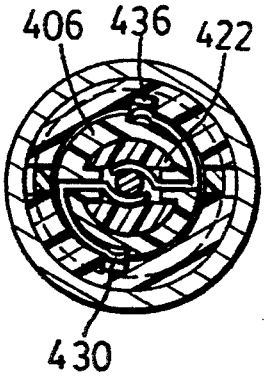
FIG. 8(B) shows a cross sectional view of the upper portion of the writing instrument of the present invention taken along the line VIII—VIII in FIG. 8(A)
Figure 9A:
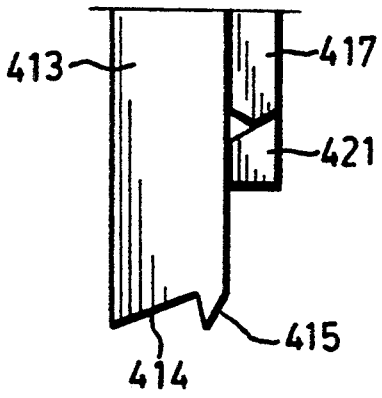
FIGS. 9(A), 9(B), 9(C) and 9(D) respectively illustrate how the push-button shown in FIG. 4 moves with respect to the cap member shown in FIG. 3 when changing from the writing position to the non-writing position and vice-versa.
Figure 9B:
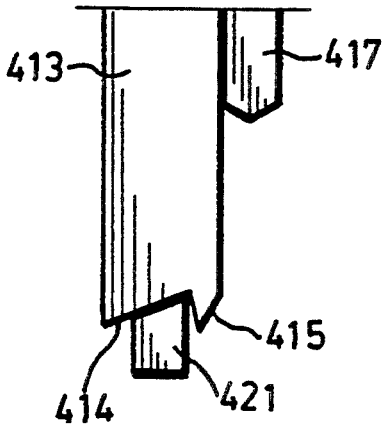
Figure 9C:
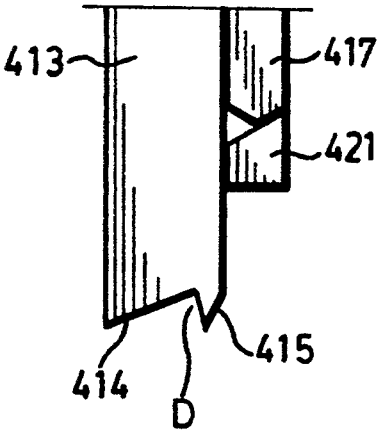
Figure 9D:
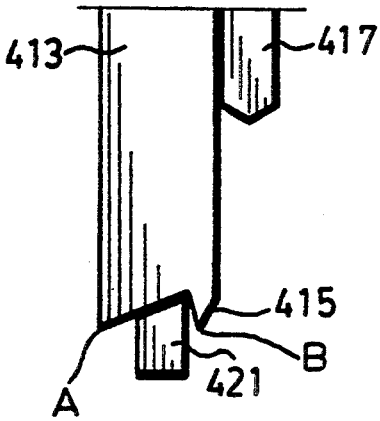

Referring to FIGS. 5(A) and 5(B) and FIGS. 9(A) through 9(D), note that the portion adjacent to the distal end (B) is inclined relative to the side 415 of the engaging rib 413. After the thrusting assembly 4 is mounted on the conductive barrel 1, the projections 417 of the push-button 403 are biased by the protrusions 421 of the insulating switch bar 404, as shown in FIG. 9(A). Under such a condition, the ink tube 20 of the writing instrument is at a first position, wherein the ink tube 20 is disposed inside the transparent nib casing, i.e a non-writing position with the light assembly at a switch-off condition. When the push-button 403 is pressed against biasing action of the spring 21, the protrusions 421 of the insulating switch bar 404 move downwardly together with the push-button 403 along the gaps (C). During the downward movement, the protrusion 421 of the insulating switch bar 404 rotates relative to the push-button 403 upon sliding beyond two adjacent distal ends (A, B) of the engaging ribs 413. This is due to the meshing teeth 416, 420 and the inclined abutting faces that are formed on the projections 417 and protrusions 421 of the push-button 403 and the switch bar 404. Thus, the protrusions 421 of the switch bar 404 engage the engaging notches (D) of the cap member 400, as shown in FIG. 9(B). Under such a condition, the ink tube 20 of the writing instrument is disposed at a second position, wherein the ink tube 20 is disposed inside the nib casing, i. e a writing position with the light assembly at a switch-off condition. The conductive tongues 430 are spaced from the rib members 436 of the clip assembly, as shown in FIGS. 6(A) and 6(B). A second pressing action on the push-button reverts the ink tube 20 back to the first position, as shown in FIG. 9(C) and in FIGS. 7(A) and 7(B). A third pressing action on the push-button 403 results engagement of the protrusions 421 of the switch bar 404 within the engaging notches (D) of the cap member 400, as shown in FIG. 9(D). The ink tube 20 of the writing instrument is disposed at the writing position. The conductive tongues 430 on the insulating sleeve member 406 rotate together with the insulating switch bar 404 relative to the push-button 403 so as to contact electrically the axially extending rib members 436 of the clip assembly 408, as best illustrated in FIGS. 8(A) and 8(B). Thus, the light assembly 3 is at a switch-on condition.

In this embodiment, the insulating sleeve member 406 has a pair of holding ribs-428 for holding the conductive tongues 430 securely thereon. The conductive tongues 430 cover the insulating sleeve member 406 at two opposed portions on the external surface of the insulating sleeve member 406. The sleeve member 406 is, in turn, retained securely on the switch bar 404 by the use of the locking bolt 407 and the retaining ring member 409 so that the position of the conductive tongues 430 is not altered even after a long period of use. The rib members 436 of the clip assembly 408 is in sliding contact with the external surface of the insulating sleeve member 406 so that the conductive tongues 430 engage the rib members 436 when rotated to a predetermined angular distance. Thus, the writing instrument of the present invention provides a better electrical contact when compared to the prior art. While the present invention has been described in connection with what is considered the most practical and preferred embodiment, it is understood that this invention is not limited to the disclosed embodiment, but is intended to cover various arrangements included within the spirit and scope of the broadest interpretation so as to encompass all such modifications and equivalent arrangement.

I claim:

1. A writing instrument with a light assembly, said writing instrument including:

a conductive barrel having an open top end and an open bottom end;

a nib assembly including a transparent hollow nib casing which has an open top end connected to said open bottom end of said conductive barrel and an open bottom end, an ink tube which has an upper end and a lower writing tip and which is disposed inside said nib casing, a coil spring sleeved around said ink tube, said coil spring having a first end that bears against said nib casing and a second end that pushes said ink tube to be extensible into said conductive barrel;

a lamp assembly disposed slidingly inside said conductive barrel, said lamp assembly having a lowermost end abutting said upper end of said ink tube, said lamp assembly including an insulating lamp holder that retains a lamp with a first electrode in electrical communication with said conductive barrel and a second electrode, said lamp assembly further including an insulating battery seat which has an upper end abutting against said lamp holder, said battery seat receiving a battery therein, said battery having a first terminal connected electrically to said second electrode of said lamp and a second terminal;

a thrusting assembly including a hollow insulating cap member which has an open bottom end connected to said open top end of said conductive barrel and an open top end, a push-button provided on said open top end of said cap member, an elongated insulating switch bar which has an upper end portion extending into said cap member and which is in sliding contact with a lower end of said push-button, said insulating switch bar further having a lower end portion with a threaded axial blind bore and two split members extending axially and downwardly from said lower end portion to define cooperatively a receiving slot therebetween and which communicates with said blind bore, and means for rotating said insulating switch bar relative to said push-button upon operation of said push-button between a switch-off condition to turn off said lamp and a switch-on condition to turn on said lamp, said push-button being operable against biasing action of said coil spring to move said ink tube between a first position, wherein said writing tip is disposed in said nib casing while said lamp at said switch-off condition, and a second position, wherein said writing tip extends out of said nib casing through said open bottom end of the latter while said lamp is at said switch-on condition;

a metallic clip assembly clamped between said cap member and said open top end of said barrel;

wherein the improvement comprises:

said thrusting assembly including: an insulating sleeve member sleeved around said split members and having an external surface; a pair of conductive tongues mounted to said insulating sleeve member in such a manner that said conductive tongues cover said external surface of said insulating sleeve member at two opposed portions, said conductive tongues having a pair of curved portions extending into said receiving slot of said split members and cooperatively forming a clamping ring between said split members; and a conductive locking bolt inserted axially between said split members and threaded to said blind bore and engaging said clamping ring to retain said insulating sleeve member on said split members, said split members extending into said conductive barrel such that a lowermost end of said conductive locking bolt is in electrical communication with said second terminal of said battery;

said metallic clip assembly including a ring member sleeved around said split members of said insulating switch bar and disposed between said insulating sleeve member and said push-button, a pair of opposed rib members extending axially and downwardly from said ring member and being in contact with said external surface of said insulating sleeve member, and a clip member which is exposed exteriorly of said barrel and which is in electrical communication with an external surface of said conductive barrel;

whereby, said conductive tongues of said insulating sleeve member are spaced from said axially extending rib members of said clip assembly when said insulating switch bar is at said switch-off condition, and said conductive tongues of said insulating sleeve member are in electrical contact With said axially extending rib members of said clip assembly when said insulating switch bar is at said switch-on condition.

2. The writing instrument as defined in claim 1, wherein said insulating sleeve member further includes a pair of holding ribs which extend radially and inwardly therefrom and which respectively have an elongated groove for holding a section of each of said conductive tongues adjacent to said curved portions.

3. The writing instrument as defined in claim 1, wherein said thrusting assembly further includes an insulated retaining ring member sleeved around said split members below said insulating sleeve member and connected to said open bottom end of said cap member so as to prevent said insulating switch bar from disengaging said cap member.

4. The writing instrument as defined in claim 1, wherein said cap member has an inner wall surface, said rotating means being constituted by: four angularly spaced and axially extending engaging ribs formed on said inner wall surface, each of which having two parallel sides with two distal ends and two inclined abutting faces that define cooperatively an engaging notch between said two distal ends, each adjacent two of said engaging ribs defining a gap therebetween; four axially extending projections formed on an external surface of said push-button adjacent to said lower end, each of said projections having a downwardly oriented inclined abutting face; a circle of teeth formed around said lower end of said push-button; four angularly spaced and axially extending protrusions formed on said insulating switch bar, each of which having an abutting face to complement said abutting face of said push-button; and a circle of upwardly oriented mating teeth formed around said insulating switch bar to mesh with said circle of teeth of said push-button;

whereby, said push-button moves relative to said cap member among a non-writing position, wherein said ink tube is at said first position, said projections are in said gaps and said conductive tongues of said sleeve member are spaced from said ribs members of said clip assembly, a writing position, wherein said ink tube is at said second position, said projections engage said engaging notches of said engaging ribs while said conductive tongues of said sleeve member are spaced from said rib members of said clip assembly, and a writing-and-lighting position, wherein said ink tube is in said second position, said projections engage in said engaging notches of said ribs while said conductive tongues of said sleeve member are in electrical contact with said rib members of said clip assembly.

* * * * *

UNITED STATES PATENT AND TRADEMARK OFFICE

CERTIFICATE OF CORRECTION

PATENT NO. : 5,413,429

DATED : May 9, 1995

INVENTOR(S) : Shiau

It is certified that error appears in the above-identified patent and that said Letters Patent is hereby corrected as shown below:

Column 5, line 64, after "slot" delete -- 423 --.

Column 5, line 65, after "bore" delete "425" and insert -- 423 --.

Signed and Sealed this

Tenth Day of October, 1995

Bruce Lehman

*Attest:*

BRUCE LEHMAN

*Attesting Officer*

*Commissioner of Patents and Trademarks*